United States Patent [19]

Sekido

[11] Patent Number: 4,676,662

[45] Date of Patent: Jun. 30, 1987

[54] LARGE CLOCK DRIVEN BY SOLAR CELL

[76] Inventor: Chiaki Sekido, No. 28-12, Tokumaru 4-chome, Itabashiku, Tokyo, Japan

[21] Appl. No.: 809,413

[22] Filed: Dec. 16, 1985

[51] Int. Cl.[4] ..... G04B 19/04

[52] U.S. Cl. ..... 368/238; 368/205

[58] Field of Search ..... 368/238, 205

[56] References Cited

FOREIGN PATENT DOCUMENTS 706614 3/1965 Canada ..... 368/238

*Primary Examiner*—Bernard Roskoski

*Attorney, Agent, or Firm*—Wenderoth, Lind & Ponack

[57] ABSTRACT

A large clock with a dial plate having short and long hands driven by a solar cell. The clock is provided with a sealed box-like long hand and a circular chain around the dial plate. The long hand slowly progresses around the circular chain which is engaged by a pinion protruding from the foremost tip of the long hand and driven by a D.C. motor energized by the solar cell. It is found that a small amount of energy is sufficient for driving the long hand by its outer end than by its inner end positioned at the center of the dial plate.

10 Claims, 13 Drawing Figures

LARGE CLOCK DRIVEN BY SOLAR CELL

BACKGROUND OF THE INVENTION

Field of the Invention

The present invention relates to a large clock with a dial plate having short and long hands, and particularly, larger than 50 cm, and driven by a solar cell placed on the long hand. The large clock of the invention consists in the provision of a sealed box-like long hand in which an electric clockwork movement and a D.C. motor are accommodated, and also a circular guide around the circular dial plate. The long hand slowly progresses on the circular guide and meshes with a wheel protruding from the foremost tip of the long hand and driven by the D.C. motor energized by the solar cell.

The present invention relates in general to a large clock having a large dial plate driven by a solar cell including a tower or turret clock positioned at a high place of a skyscraper building, and more particularly, to what we call a "FLOWER CLOCK" installed on a flower bed of a park or playground in which a solar cell, the source of an infinite energy, is applied for providing the driving power of the clock, and further, maintenance care is hardly required.

Although the magnitude of the diameter of a dial plate of a conventional large clock, for instance, more than 20 meters, may be technically feasible to make, it is generally regarded as infeasible from an economical point of view. A significant reason is because a long hand becomes long and heavy, and an electric motor for driving the long and heavy long hand must be so powerful that other ancillary parts must be made correspondingly firm and durable.

SUMMARY OF THE INVENTION

The present invention has overcome the above difficult problem, has been successful in creating clocks in which the length of a long hand of the clock can be made as long as desired. The diameter of the dial plate also can be made large.

The gist of the clock of the invention lies in the provision of a circular guide means on its dial plate which supports the foremost tip of a long hand to directly drive it along the guide means with a point contact with a wheel attached to the tip of the long hand. Its is entirely the same with the conventional clock wherein a long hand together with the short hand are co-operatively supported on the co-axis positioned at the middle of the dial plate.

The "point contact" refers to a momentary contact of the tip of the long hand with one point of the guide means to make progress therealong.

By the above novel contrivance, the long hand of the invention is supported by a rotatable co-axis at the middle of the dial plate, and at the same time by the point contact with the circular guide means; in other words, the foremost tip and other end (positioned at the middle of the dial plate) of the long hand are supported by two points. Accordingly, the length of the long hand can be made as long as desired or required, and with reference to the driving energy to drive the long hand, it is seen that it can be much less reduced than that for clock's having only one point support of the long hand at the middle of the dial plate.

The driving force of the long hand of a conventional large clock, since the clock is supported by a single point at the middle of the dial plate, is governed by a physical law, "the amount of force or torque is equal to the product of a force and distance through which the force acts". In this case, let the length of the long hand from its single fulcrum to its tip be a distance. In other words, the longer the long hand becomes, the greater the force required for driving it becomes.

On the other hand, in the present invention one end of the long hand is supported on a rotatable fulcrum positioned at the middle of the dial plate, and the other end (foremost) thereof is supported on the circular guide means, and it is seen that long hand is driven by pushing the foremost tip thereof with a remarkably small force.

Accordingly, it is a prime object of the present invention to provide a novel large clock wherein its long hand is supported at two points on the dial plate, one at the middle of the dial plate and the other at its tip, and the long hand is not driven by a motor provided at the middle of the dial plate, but by a motor installed at its tip; a circular guide is provided around the circumference of the dial plate; a toothed wheel driven by the motor of the tip and protruding from the tip of the long hand, and the toothed wheel is engaged with the circular guide to proceed thereon minute after minute; whereby the clock can be driven by less electric energy than can a conventional one.

Another object of the invention is to provide a large clock, particularly a large flower clock, with the novel support and drive system of which the clock is able to be installed at any desired position and location, for instance, a perpendicular position or any desired oblique position, or horizontal to the flower bed, whereby it may impress upon any onlooker a favorable feeling.

Still another object of the invention is to provide a large clock the long hand of which can be elongated more than 10 meters in its length, hitherto considered impossible, by a novel and effective two-point support system of the long hand.

Still another object of the invention is to provide a large clock in which the clockwork mechanism is not only simplified but also its operation including maintenance is simplified as compared with the conventional large clock so as to considerably reduce its manufacturing cost.

Still another object of the invention is to provide a large clock, particularly a flower clock in which a solar cell having an infinite source of electric energy is installed to extend the effective life of the flower clock installed in the open air and improve an outdoor application of the clock.

A still additional object of the invention is to provide a large clock intended for an auditorium which is able to hang down from a ceiling with a desired angle of inclination, and further, having a remarkable light weight.

A still further object of the invention is to provide a large clock in which its long hand is made so safe and strong so as to allow a child to ride thereon with a view for impressing upon the child how long a minute lasts.

BRIEF EXPLANATION OF THE DRAWINGS

Other and further objects of the invention will become apparent from the following detailed description with reference to the drawings which, by way of example, illustrate a preferred embodiment of the invention, in which.

In order to make a distinct comparison between the clock of the prior art and of the present invention, the construction and clockwork mechanism of the conventional clock are described with reference to FIGS. 1–2.

Figure 1:
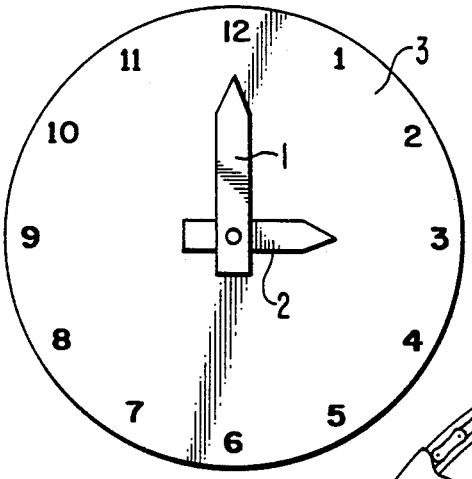
FIG. 1 PRIOR ART
FIG. 1 is a top plan view of a conventional large clock.

In the top plan view of the conventional clock shown in FIG. 1, a long hand 1 and a short hand 2 are provided on the dial plate 3, and the long hand 1 together with the short hand 2 are supported at the middle of the dial plate coaxially. The numerals 1, 2 . . . 12 on the dial plate 3 refer to the hours, respectively.

Figure 2:
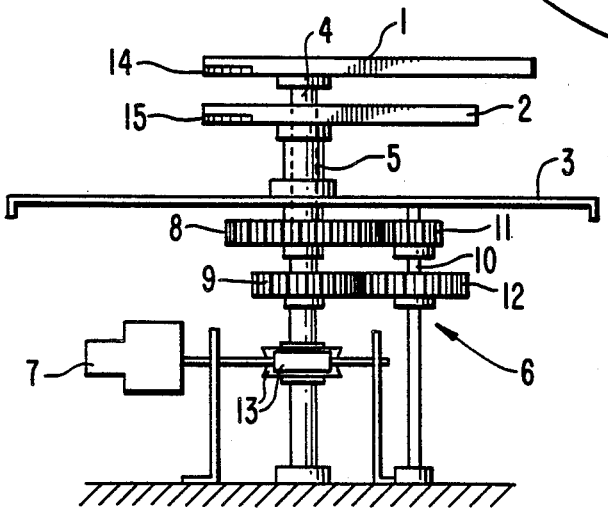
FIG. 2 PRIOR ART
FIG. 2 is a side view of FIG. 1 showing a clockwork mechanism of FIG. 1 under the dial plate 3.

FIG. 2 shows an electric clockwork mechanism provided under the dial plate 3 of FIG. 1. The long hand 1 is supported on a rotatable axis 4 and the short hand 2 is also supported on a rotatable axis 5. Two rotatable axes 4 and 5 are provided so that the axis 4 pierces through the axis 5 to be a coaxial as shown in FIG. 2. It is understood that both hands 1 and 2 are fixed at their tops, respectively.

The rotatable axes 4 and 5 are separately and independently rotated in the right direction or clockwise with the middle point of the dial plate 3 as respective fulcra thereon, and the rotatable axis 4 makes the long hand 1 rotate once on the dial plate 3 correspond to one hour while the rotatable axis 5 makes the short hand 2 proceed clockwise with of a rate of one-twelfth that of the long hand 1.

Accordingly, a train of toothed wheels are provided in the clockwork movement to rotate both hands with a definite rate on the dial plate.

The rotatable axis 5 of the short hand 2 is provided with a toothed wheel 8 while the axis 4 of the long hand 1 is provided with a toothed wheel 9. The toothed wheel 8 meshes with a toothed wheel 11 attached to another rotatable axis 10. Similarly, the toothed wheel 9 meshes with a toothed wheel 12 attached to the rotatable axis 10.

It is arranged so that the ratio of rotation between two toothed wheels 8 and 11 is 1:4 and the ratio of rotation between the two toothed wheels 9 and 12 is 3:1.

Therefore it follows that the long and short hands 1 and 2 rotate on the dial plate 3 with the ratio of 12:1 by the operation of the train of toothed wheels.

The rotatable axes and train of toothed wheels are all driven by a single motor 7 as follows: the rotation of the motor 7 is transmitted to the rotatable axis 4 of the long hand 1 via a worm gear mechanism 13, and subsequently, the rotary force is transmitted to the rotatable axis 5 of the short hand 2 via the train of toothed wheels, i.e., toothed wheel 9—toothed wheel 12—rotatable axis 10—toothed wheel 11—toothed wheel 8 with the result that it works as a common clock.

In FIG. 2, it is illustrated that a counter-weight 14 is provided at an end of the long hand 1, this end is near the middle rotatable axis 4 thereof, and another counter-weight 15 is also attached to one end, near the middle rotatable axis 5 of the short hand. These counter-weights 14 and 15 are provided for stopping both hands at their exact minute and hour time, respectively, in order to maintain equilibrium.

It is to be noted, however, that the above counter-weight is no longer required to be attached to the end of long or short hand in this invention. This is described again later on, and it is distinctly clear that the long and short hands of this invention are lighter in weight than those of the conventional clock.

In addition, it is understood that the motor 7 should be driven according to the known electric clockwork system.

As described above, the length of a long hand is limited from a commercial point of view in accordance with the construction and drive system of a large clock of the prior art. For instance, if a large flower clock having the diameter of its dial plate being 20 meters is desired to be built, the output of an electric motor should be so selected as much as about 5 kilowatt or more. On the contrary, an output as less as one-fiftieth, 100 watts is sufficient for the operation of a similar large flower clock constructed in accordance with the principle of the present invention. In addition, it is clear that every part of the large clock should be manufactured strong and firm so as to endure the rigorous operation accompanied with the increase of motor power.

Figure 3:
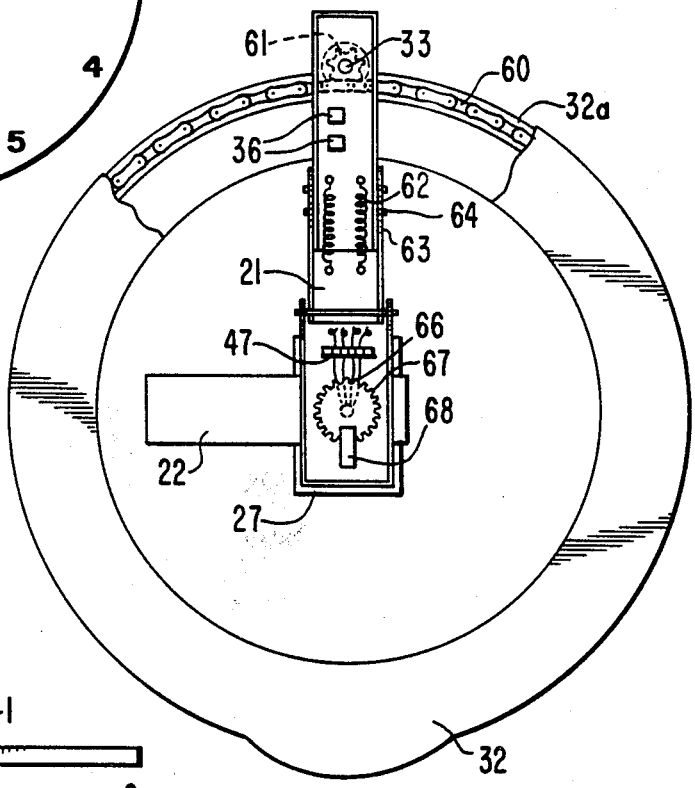
FIG. 3 is a top plan view of a large clock the present invention.
Figure 4:
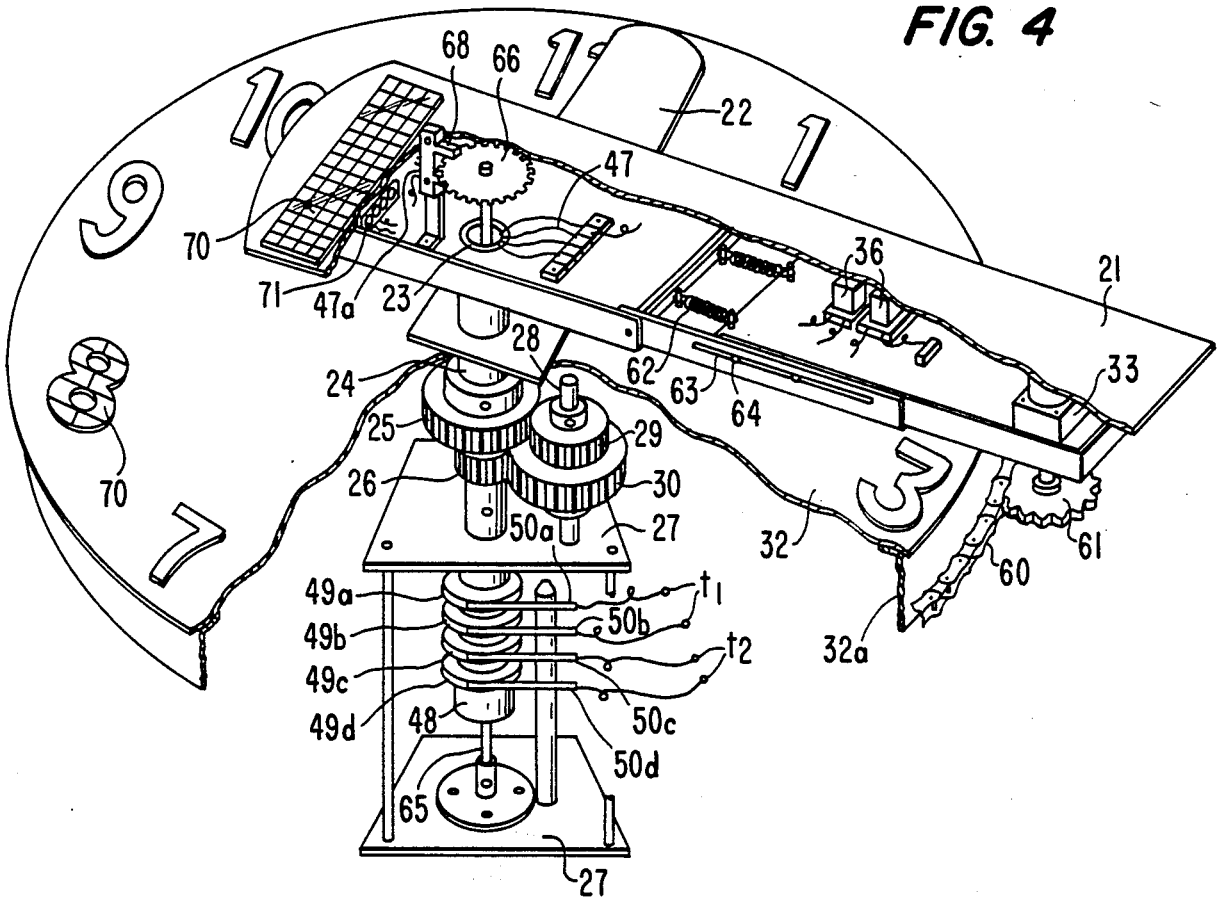
FIG. 4 is a perspective view of the large clock of the invention, and this view is a partial sectional view with a part of the dial plate removed.

FIG. 3 is a top plan view of a large clock provided with a solar cell in accordance with the present invention, and FIG. 4 is a perspective view of FIG. 3 with a partial sectional view. In this invention, a long hand 21 on dial plate 32 is rotatably mounted on a rotatable axis 23 (FIG. 4) and a short hand 22 is similarly mounted on a rotatable axis 24 (FIG. 4); the rotatable axis 23 is pierced through the rotatable axis 24 to form a co-axial construction just like the large clock of the prior art.

However, neither the long hand 21 nor the short hand 22 requires any counterweight at all. The counter-weight provided at one end of either long or short hand is an indispensable weight for the conventional large clocks. The reason why the counterweight on the end of both hands no longer required is because they are desired to be as lightweight as possible and also the long hand 21 is supported on the two-point system, i.e., on the rotatable axis 23 positioned in the middle of the dial plate and its foremost tip from which a toothed wheel protrudes, and the long hand is driven by the toothed wheel meshing with a circular guide provided around the circumference of the dial plate described in detail hereinafter. In regard to the counterweight of the short hand, the short hand is a dependent one in this invention, hence no counterweight is required.

A distinct difference between the present invention and the prior art is clearly shown in FIG. 3 wherein a circular guide 32 is provided around the circumference of the dial plate, and the circular guide 32 is applied by a sprocket chain 60 of the same type used for bicycles. The sprocket chain 60 is not employed on the surface of the dial plate with a perpendicular form thereon, i.e., the chain consists of a series of rollers joined together by side walls having a void or space formed between two neighboring rollers, and the void or space is engaged by a tooth of the toothed wheel. In the known common form of the chain, the void between two rollers can pass through any straight bar, but in this invention the chain is provided with its void directed upward on the dial plate in the form of a circle wherein the void is unable to be passed through, because the top meshes with a tooth and the bottom is closed by the dial plate itself. This modified chain is not available in the market, but must be made to order. Accordingly, a feature of the present invention lies in the provision of a novel form of the sprocket chain on the flat face of the dial plate as a circular guide.

In addition, it is feasible to provide the above modified sprocket chain on the circular edge of the dial plate and not on the face thereof; in other words, it is arranged so that the top and bottom of a void between two rollers of the chain are open, i.e., a straight bar can pass through the void, because the botton of the void is not closed at all.

The chain 60 is in mesh with a toothed wheel 61 protruding from the forward tip of the long hand 21. It is understood that the tooth of the toothed wheel corresponds to a sprocket; in other words, the known rack and pinion mechanism corresponds to the mechanism where the tooth of the toothed wheel 61 meshes with the void of the chain 60 in this invention. That is to say, the chain is the rack while the toothed wheel 61 is the pinion.

Furthermore, in the rack and pinion mechanism, it is also understood that the plane on which the rack is provided may be different from another plane on which the pinion is installed so long as the rack-and-pinion mechanism works well; namely, these are three cases: (a) both planes are mutually parallel; (b) both planes are mutually perpendicular; and (c) both planes are mutually oblique.

In addition, the chain has many voids between two neighboring rollers and the void meshes with one tooth of the toothed wheel, but the number of voids may not be limited to 60, namely, one tooth in mesh with one void per minute. If the same sprocket chain is applied to a dial whether big or not, it is understood that the larger the circular guide of chain the larger the number of voids.

In the present invention, the motion of the long hand 21 per minute should progress depending on the definite standard time, therefore the tooth of the toothed wheel with the chain progresses minute after minute.

In addition to the sprocket chain of the type used in bicycles as a circular guide on the dial plate, various kinds and forms of guides may be applied, such as, rack and pinion, and the engagement system of rail with wheel of the railroad and streetcar, etc.

The chain may be directly attached on the dial plate, or attached by means of a guide plate. The numbers representing the time may be printed on the guide plate in addition to the dial plate.

The position where the chain 60 is provided may be selected at any desired position, such as, the intermediate position of the long hand, depending on the selection from a design point of view.

Figure 7:
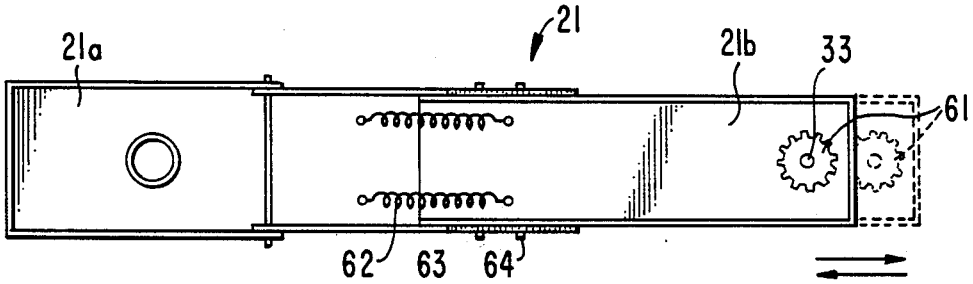
FIG. 7 is a top plan view of a box-like long hand of the clock with the upper lid or cover removed.
Figure 8:
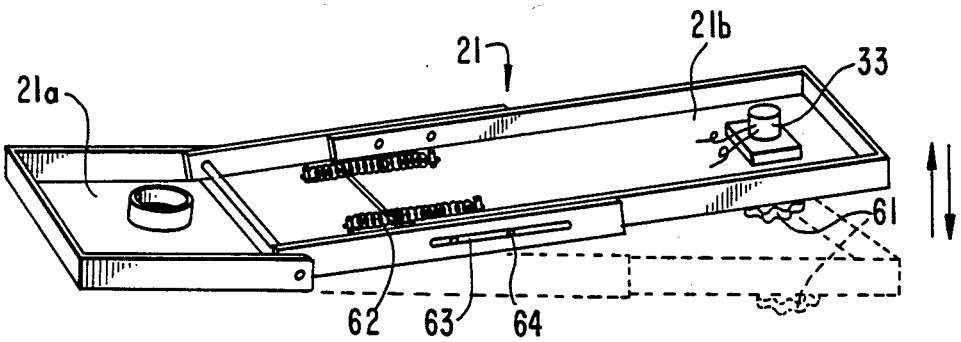
FIG. 8 is a perspective view of the box-like long hand of FIG. 7.

As clearly shown is FIGS. 7–8, the shape of a long hand 21 is a long oblong box, and this box can be sealed with a lid or cover (not shown). The long hand box may be made of any desired material, such as, metal, light metal, and engineering plastics, etc. In the box, a drive motor 33 is provided at its foremost tip, and the drive motor 33 is a geared D.C. motor, i.e., provided with a speed reducing gear and controlled by the electric clockwork system. The D.C. motor 33 is operatively connected to a toothed wheel 61 protruding from the long hand box as shown in FIG. 8. Since the long hand 21 is made as a sealed box, the rain, snow and moisture can be completely prevented from penetrating into the inside of the box.

In addition, as shown in FIGS. 7–8, the long hand box 21 may be divided into two parts 21*a* by a joint, and further, the part 21*b* may be extended by means of a spring 62, and a sliding pin 64 sliding along a sliding groove 63. Two parts 21*a* and 21*b* are so arranged that both parts freely bend together, and they work well when a flower clock with the long hand of the above construction is installed on a stepped ground of the flower bed. The long hand can freely follow along the stepped flower bed, and besides, it can freely be elongated when necessary.

It is understood that the two-part or three-part long hand is able to provide a wider freedom of design to a designer of a large clock.

With reference to the design of a short hand, the shape and construction of the short hand can be selected as freely as desired so long as the short hand and the long hand act in harmony.

Figure 6:
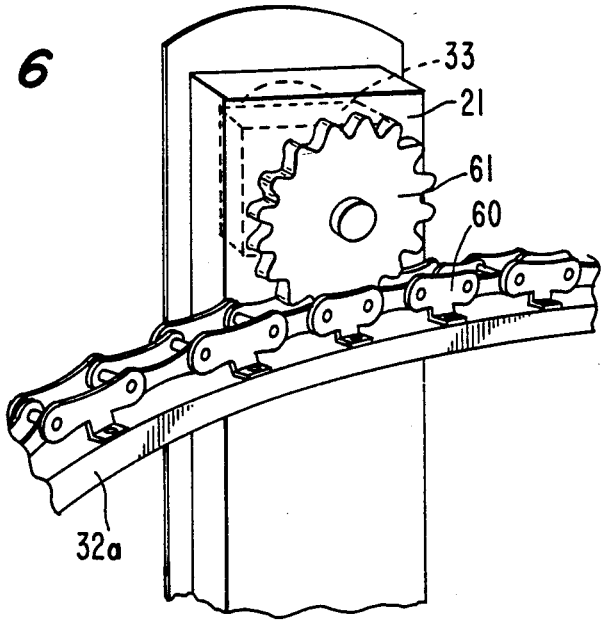
FIG. 6 is a portial perspective view showing how a toothed wheel driven by the motor meshes with a sprocket chain provided around the circumference of the dial plate.

To provide a sprocket chain 60, of the type used in bicycles, on the dial plate 60 of the large clock I have considered four methods as follows:

(1) The common form of a chain, of the type used in the bicycles comprises a series of voids between two adjacent rollers, and the void meshes with one tooth of the toothed wheel; the top and bottom sides of the void are open; and the common form of the chain is provided on the dial plate with a circular form. In this method, both sides of the void are freely open (see FIG. 3 and FIG. 6)

(2) The common form of the chain as described in Item (1) is provided around the circular edge of the dial plate via a base plate 32*a*. The base plate 32*a* is required for fixing the chain around the circular edge or fringe of the dial plate because the thickness of the dial plate may be too thin to fix the chain. In this case, both sides of the void are as open as those described in Item (1). It is understood that the base plate 32*a* is perpendicular to the dial plate (see FIG. 6, and FIGS. 11–13).

Figure 10:
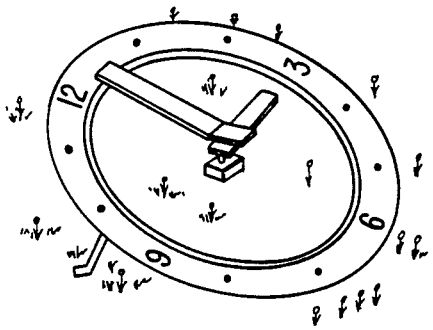
FIG. 10 is a view showing the position of the large clock of the invention where it is installed almost on a horizontal level of the ground.
Figure 11:
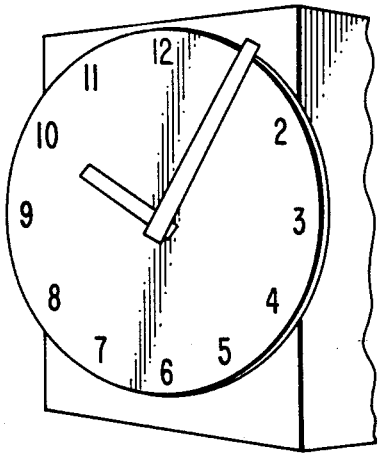
FIG. 11 is a view of the large clock set at a perpendicular position.
Figure 12:
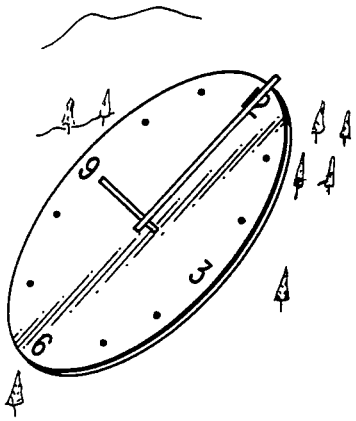
FIG. 12 is a view of the large clock positioned at a desired angle of inclination.
Figure 13:
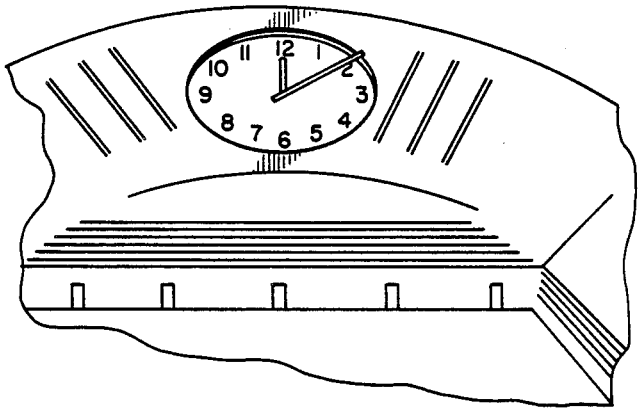
FIG. 13 is a view of the large clock hanging down from the ceiling of an auditorium.

(3) The common form of the sprocket chain is modified as having the direction of each element consisting of the chain being perpendicular to the original direction when it is fixed on the flat circular dial plate, i.e., the top of the void is open to mesh with a tooth of the toothed wheel, but its bottom is completely closed by the flat board of the dial plate. Hence it may be easy to fix the modified chain in a straight form on the dial plate, but the modified chain should be fixed in a circular form in this invention. To manufacture a modified circular chain to be fixed on the round dial plate is somewhat of a difficult job, because each element of the chain should correspond to the circular form (see FIG. 10).

(4) A guide plate 32*a* is attached to the round edge or fringe of the dial plate 32 perpendicular thereto, and the modified chain of (3) is provided on the round guide plate 32*a*. In this case, the bottom of the void of the chain is closed by the plate of the round guide plate 32*a*. In any of the above methods 1–4, it is relatively easy for the machine designer to contrive a toothed wheel 61 connected through the wall of the long hand box to the rotatable shaft of the D.C. motor provided within the box of the long hand so that a tooth of the toothed wheel meshes with a void of the sprocket chain.

One feature of the long hand box of this invention lies in the accommodation of a control circuit 36 of the electric clockwork mechanism therein. As shown in FIG. 4, the long hand box accommodates the control circuit 36, a storage battery 71 for the electric energy supplied from a solar cell 70 provided on the lid or cover of the long hand box, a photo-detector or photo-sensor 68 together with a round disk 66, D.C. motor 33 and other components therein.

The control circuit 36 comprises a pulse generator 41, a relay for starting the motor 42, a holding circuit 43, a stop switch 44, and a geared D.C. motor 33. The constitution of the above control circuit for the electric clockwork is a known one in the industry.

In this invention, a solar cell 70 is provided on the one end of the long hand 21 as shown in FIG. 4, and further, another solar cell is provided on the hour mark 8. All the hour marks 1–12 may be provided with respective solar cells thereon. A storage battery 71 for storing an electric energy supplied from the solar cell is also provided within the sealed box of the long hand. The pulse generator is accompanied by a crystal or quartz oscillator (not shown).

The electric energy supplied from the solar cell 70 together with the storage battery 71 actuates the pulse generator via the quartz oscillator (not shown); the pulse generator 41 generates a pulse signal per minute; the pulse signal is transmitted to the relay circuit 42 which starts the geared D.C. motor; the D.C. motor is driven via the holding circuit 43; and finally, the stop switch 44 works to stop the motor 33 as soon as one minute has elapsed.

The remarkable development of the recent electronic technology has attained the miniaturization of electronic parts to accommodate them within a small space of the sealed box of the long hand 21.

The stop switch means used in the large clock of the prior art for stopping the long hand consists generally of a cam switch or mercury switch.

Figure 9:
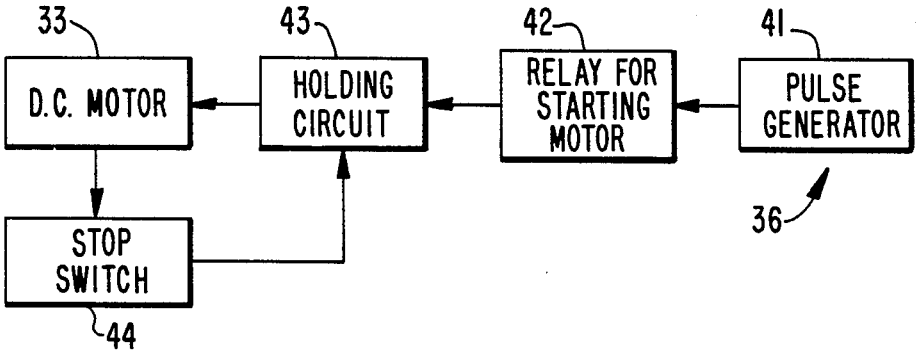
FIG. 9 is a block diagram showing the control circuit system of an electric clockwork contained in the box-like long hand.

In accordance with the present invention, the above stop switch means 44 (FIG. 9) utilizes a photo-detecting means consisting of a photo-emitting element 68 and a photo-receiving element 69 (FIGS. 3–5) and a round disk 66 having 60 notches 67 around the circumference thereof. The photo-detector or photo-sensor works as follows: the round disk 66 is mounted on a fixed shaft 65 (FIGS. 4–5) which extends through the long hand 21 above, and also penetrates through the rotatable shaft 23 which supports the long hand 21. The round disk 66 is firmly fixed to maintain a definite position, and it is provided with 60 notches 67 around its circumference as in the form of a toothed wheel having 60 teeth. The 60 notches are provided with the same angle and with at equal intervals around the wheel, respectively.

The notches 67 of the round disk 66 are sandwiched between the photo-emitting element 68 and the photo-receiving element 69. The photo-emitting element 68 is always energized by electric current to emit light while the photo-receiving element 69 always receives light. When one notch is sandwiched between the two elements 68 and 69, the light emitted by the element 68 reaches the element 69 through the notch, and the thus the detected output of the element 69 actuates the stop switch 44 to release the holding circuit 43. Since there are 60 notches on the round disk 66 and one notch is assigned to one minute, the long hand 21 completely stops per minute. Though the round disk 66 is immobile, the photosensor means provided on the long hand makes progress minute after minute, hence the photo-sensor also progresses minute after minute together with the long hand so as to emit light through the notch of the round disk per minute, because the round disk 66 has sixty notches.

It is known that the above photo-sensor means is generally applied to detect coins in automatic vending machine.

Figure 5:
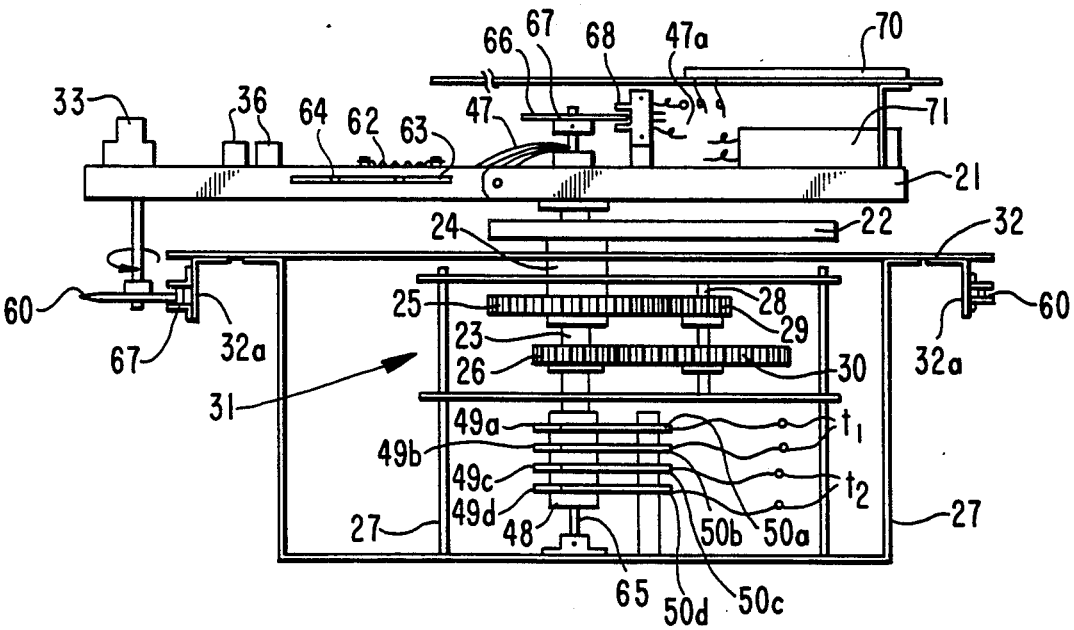
FIG. 5 is a side view of the clock of the invention including several parts on its dial plate and other parts under the dial plate.

The photo-emitting element 68 is at all times electrically energized to emit light by a lead wire 47*a* via a lead wire 47 connected to a slip ring means 48. As shown in FIGS. 4–5, the slip ring means 48 is provided under the dial plate, and the function of the slip ring means 48 is described in detail hereinafter. The photo-emitting element 68 is also provided with an amplifier, and such an element as the element 68 is available in the market and well known.

The control circuit 36 from which a pulse is generated and also which works as an electric clockwork is electrically energized by the lead wire 47 penetrating through the rotatable axis 23 of the long hand as shown in FIGS. 4–5.

The large clock of the invention is driven by the solar cell 70 and the storage battery 71 connected thereto, hence the control circuit 36 is also energized by the solar cell 70 and the storage battery 71. However, when it is cloudy, raining, or snowing and no sunshine is utilized, it is understood that a spare electric source should be provided. Needless to say, where there is an excess of electric energy from the solar cell, it is required to provide a storage battery 17. In case of some trouble, the temporary use of commercial electricity should be prepared; in this case, the slip ring means 48 is utilized.

The time control for the large clock of the invention of this invention is governed by the following two methods:

(1) The long hand is controlled by the control circuit 36 which governs the exact time, and it makes progress on the sprocket chain as its guide minute per minute.

(2) At the same time the long hand stops once per minute by the work of the photo-sensor means which acts as a stop switch means. In the time control of a large clock, it is known that the control of the above (2) is absolutely necessary for the exact control.

For reference, the results of an experiment I have conducted are described hereinbelow.

In order to design the manufacture of a flower clock having the diameter 5 meters of the dial plate, an experimental clock of 50 cm in diameter, one-tenth of 5 m, has been really made, and I have investigated how much the electric energy is consumed. The solar cell is used as a single electric source. An electric voltage imposed on a quartz oscillator is 12 v D.C. and 40 milliampere; a D.C. motor consumes 400 milliampare as 12 v×5 watt, and the long hand makes progress for three seconds to reach one minute, and thereafter it stops for 57 seconds.

On the analogy of the above experimental results, it is supposed that in a large flower clock of 5 m diameter the long hand makes progress for 30 seconds to reach one minute and consume 4,000 milliampere by converting the capacity of the motor as 12 v×50 watt and driving it.

In another experiment, it has been found that when the long hand of 2 m long weighting 2 kg of the two-point support system of the invention is driven by the motor installed at the foremost tip of the long hand, an electric energy consumed amounts to 5 watt only while, on the other hand, the same long hand of the prior art supported on one point, i.e.; at the middle of the dial plate and driven by the motor consumes as much as 60 watts.

In this invention, a solar cell 70 is provided on the long hand 21 as shown in FIG. 4, and another solar cell on the hour mark (8 in FIG. 4). It is known that the solar cell comprising an amorphous silicon is able to be formed in any desired shape, and it is also placed at any position away from the flower clock.

It is to be noted that electric energy obtained from the solar cell 70 provided on the long hand can be directly supplied to the control circuit 36 contained within the long hand, but any electric energy from a solar cell on the hour mark, a solar cell situated away from the long hand, a commercial electricity, or a common storage battery is unable to directly supply the control circuit 36 within the long hand, because the long hand always progresses per minute and any wiring thereto may be disturbed by the constant motion of the long hand.

For preventing the above trouble, a slip ring means 48 provided under the dial plate as shown in FIGS. 4–5 is installed so that the electric energy from any source can be supplied to the control circuit 36 through the rotatable axis 23 of the long hand 21. The slip ring means 48 (FIGS. 4–5) is provided with four lead wires 47, and each end of the lead wires is connected with each ring conductor 49*a*, 49*b*, 49*c* and 49*d* attached to the slip ring 48. Four ring conductors 49*a*, 49*b*, 49*c* and 49*d* are in sliding contact with four contact members 50*a*, 50*b*, 50*c* and 50*d* mounted on a support 27, respectively, with the result that a pair of contact members 50*a* and 50*b* become a terminal t1 for a solar cell installed at other places than on the long hand and for a storage battery (except the one within the long hand box), and commercial A.C. source. A pair of contact members 50*c* and 50*d* become another terminal $t_2$ for a pulse input from a master clock (In this case, the control circuit 36).

If electric energy obtained from a solar cell is abundant enough to drive the clockwork movement of this large clock of the invention, the slip ring 48 with its ancillary ring conductors 49*a*–49*d* and contact members 50*a*–50*d* are no longer required, because the electric energy from the solar cell and its storage battery provided on the long hand can be directly supplied to the control circuit 36, hence the slip ring 48 together with accompanying components are not utilized.

As mentioned before, if the control circuit 36 contained in the long hand is directly energized by means of a lead wire connected to an outside electric source, the lead wire may be cut off by the constant motion of the long hand.

In operation, a geared D.C. motor contained in the box of the long hand 21 is actuated by the directive of the control circuit which includes a principal component of the electric clockwork movement to make a tooth of the toothed wheel 61 connected to the axis of the motor 33 mesh with a sprocket chain 60 to advance the toothed wheel 61, and the long hand 21 progresses too, on the chain while the long hand is supported at two-points, i.e., its foremost tip and its rotatable axis. Thus, the long hand 21 advances minute after minute according to the standard time on a circular sprocket chain provided on the dial plate.

With a single circulation of the long hand 21 along the sprocket chain on the dial plate, the short hand 22 also advances to indicate an hour mark via the train of gears, i.e., rotatable axis 23—toothed wheel 26—toothed wheel 30—rotatable axis 28—toothed wheel 25—rotatable axis 24. The above circulation repeats as a clock.

As soon as the long hand advances on the chain a distance corresponding to one minute while it is being engaged with the chain, the photo-sensor means comprising the photo-emitting element and photo-receiving element works at once to stop the motor. The operation of the photo-sensor means has been described hereinbefore. The stop action per minute repeats, too. Thus, one revolution of the long hand on the dial plate results in the 1/12 rotation of the short hand so as to indicate an hour mark.

As fully described in the foregoing, the long hand of the large clock manufactured in accordance with the principle of the present invention is characterized by several features as compared with the similar large clock of the prior art. The sealed oblong box of the long hand accommodates the principal clockwork mechanism, and is supported on the two-point system. Thus, the long hand is driven by much less motive power than the conventional one. One novel feature lies in the provision of a circular sprocket chain on the circumference of the dial plate, and the toothed wheel protruded from the foremost tip of the long hand and driven by the built-in motor meshes with the sprocket chain to advance and exactly tick away the time. An additional feature of the large clock of the invention is that the clock is driven by the motor energized by the solar cell installed on long hand. Where the sunshine is not available on rainy or cloudy days, a spare electric source is also able to be utilized. In addition, in accordance with a novel stop means comprising a photo-sensor of the invention, the long hand is forced to stop at every minute so as to tick away the time in a much more punctual manner. Since the important electric clockwork mechanism is fully accommodated within an entirely sealed ablong case of the long hand, it is completely sealed from moisture, rain and snow to increase the endurance life of the clock for an extended period of time.

Furthermore, in regard to the place where the large clock of the invention is situated, the clock has a wonderful feature in that it can be easily positioned at any place, whether horizontal, oblique, or vertical on the ground or any place, and besides, even on the ceiling of an auditorium.

While specific embodiments of the invention have been illustrated and described in detail to indicate the application of the principle of the invention, it will be understood that the invention may be embodied otherwise without departing from the spirit and scope of the appended claims.

I claim:

1. A clock comprising:

a dial plate;

an engagement means fixed along the periphery of said dial plate;

a small hand rotatably supported at one end on said dial plate about an axis of rotation;

a large hand rotatably supported at one end on said dial plate about said axis of rotation, said large hand having an engaging means supported at the other end thereof adjacent said engagement means and a motor means operatively connected to said engagement means and mounted on said large hand, said engaging means being driven by said motor means for engaging with and moving relative to said engagement means fixed along the periphery of said dial plate for rotating said large hand about said axis of rotation;

and means for rotating said small hand about said axis of rotation at an overall rate equal to 1/60 of that at which said large hand is rotated about said axis of rotation.

2. A clock as claimed in claim 1 wherein, said motor means is comprised of an electric motor and a means for supplying energy to said electric motor for powering said electric motor to drive said engaging means.

3. A clock as claimed in claim 2 wherein, said means for supplying energy to said electric motor is a solar cell mounted on said large hand for converting sunlight to energy for powering said electric motor.

4. A clock as claimed in claim 2 wherein, said long hand is a sealed oblong box and said electric motor is mounted in said long hand.

5. A clock as claimed in claim 4 and further comprising, a pulse generator actuated by said energy supplying means for generating one pulse signal per minute;

a relay circuit operatively connected to said pulse generator for generating a signal to start said electric motor when said one pulse is generated by said pulse generator and received by said relay circuit;

a holding circuit operatively connected between said relay circuit and said electric motor and activated by said signal generated by said relay circuit for starting said motor; and a stop switch means operatively connected to said motor and said holding circuit for deactivating said holding circuit for intermittently stopping said motor once every minute.

6. A clock as claimed in claim 5 wherein, said stop switch means comprises a photo-sensor device mounted in said long hand to rotate therewith about said axis of rotation and having a photo-emitting element for emitting a light, a photo-receiving element spaced from said photo-emitting element for receiving said light and for deactivating said holding circuit when not receiving said light, and a disk mounted within said long hand having its center fixed at said axis of rotation so as to be non-rotatable relative thereto and having its periphery locatable between said photo-emitting and photo-receiving elements as said long hand is rotated about the axis of rotation, said periphery of said disk having 60 notches spaced at equal intervals around said periphery, whereby when said disk is rotated by said long hand and any of said 60 notches is located between said photo-emitting and photo-receiving elements said stop switch is deactivated and when portions of said periphery of said disk not having one of said notches is located between said photo-emitting and photo-receiving elements said light emitted by said photo-emitting element is not received by said photo-receiving element and said stop switch is activated for deactivating said holding circuit.

7. A clock as claimed in claim 1 wherein, said engagement means is comprised of a circular guide and a sprocket chain arranged around said circular guide; and said engaging means is a sprocket rotated by said motor means and engaging said sprocket chain.

8. A clock as claimed in claim 1 wherein, said engagement means is a circular chain attached to said dial plate along the periphery thereof; and said engaging means is a sprocket engaging said chain.

9. A clocked as claimed in claim 4 wherein, said long is comprised of first, second and third sections, said first section supported at said axis of rotation, said second section being pivotally connected to said first section and said third section being telescopically mounted to said second section so as to be adjustably positionable on said dial plate.

10. A clock as claimed in claim 1 and further comprising, a supplemental drive means for rotating said long hand and said short hand comprising an electric motor adjacent said axis of rotation for exerting a torque about said axis of rotation for rotating said long hand about said axis of rotation.

* * * * *

UNITED STATES PATENT AND TRADEMARK OFFICE

CERTIFICATE OF CORRECTION

PATENT NO. : 4,676,662

DATED : June 30, 1987

INVENTOR(S) : Chiaki SEKIDO

It is certified that error appears in the above-identified patent and that said Letters Patent is hereby corrected as shown below:

In claim 9, line 1, change "clocked" to -- clock --.

Signed and Sealed this

Twenty-fourth Day of November, 1987

*Attest:*

DONALD J. QUIGG

*Attesting Officer*

*Commissioner of Patents and Trademarks*